United States Patent [19]

Yamamoto et al.

[11] 3,983,674

[45] Oct. 5, 1976

[54] SHUTTER CONSTRUCTION WITH PREFABRICATED, HORIZONTALLY MOVABLE PANEL ASSEMBLIES

[75] Inventors: Yukio Yamamoto; Akio Ikemura, both of Kurobe, Japan

[73] Assignee: Yoshida Kogyo Kabushiki Kaisha, Japan

[22] Filed: Sept. 26, 1974

[21] Appl. No.: 509,687

[52] U.S. Cl. ..... 52/458; 52/656; 52/588; 29/509; 29/515; 52/475; 52/492

[51] Int. Cl.[2] ..... E04B 5/52; E04C 2/38; E06B 5/06

[58] Field of Search ..... 52/575, 588, 656, 475, 52/627, 455–458; 49/125, 130, 372; 29/509, 515

[56] References Cited

UNITED STATES PATENTS

| | | | |
|---|---|---|---|
| 1,687,537 | 10/1928 | Brace | 52/656 |
| 1,724,052 | 8/1929 | Swearengin | 52/588 |
| 2,186,310 | 9/1940 | Von Hoefen | 52/588 |
| 3,191,724 | 6/1965 | De Ridder | 52/588 |
| 3,203,149 | 8/1965 | Soddy | 52/588 |
| 3,220,519 | 11/1965 | De Ridder | 52/588 |
| 3,703,061 | 11/1972 | Holland et al. | 52/455 |

*Primary Examiner*—Ernest R. Purser
*Assistant Examiner*—James L. Ridgill, Jr.
*Attorney, Agent, or Firm*—Bucknam and Archer

[57] ABSTRACT

In a shutter construction typically installed on the outside of a window and including one or more panel assemblies mounted within an outer frame for horizontal sliding movement into and out of a shutter box, each of the panel assemblies is composed of a supporting frame and a series of aligned elementary panels closely fitted in the supporting frame. The supporting frame consists of top and bottom rails and a pair of stiles, and the stiles are formed wth a tongue and a pair of clamping jaws, respectively, projecting toward each other. Each elementary panel also has a tongue and a pair of clamping jaws along its respective lateral edges which are exactly identical with the tongue and jaws of the stiles. The elementary panels are connected to each other and to the stiles solely by the clamping engagement of the tongues by the respective pairs of jaws.

2 Claims, 4 Drawing Figures

SHUTTER CONSTRUCTION WITH PREFABRICATED, HORIZONTALLY MOVABLE PANEL ASSEMBLIES

BACKGROUND OF THE INVENTION

This invention relates to a shutter typically to be installed on the outside of a window to shut out the light or sound, to obstruct the view or passage, or for like purposes. More specifically, the invention deals with the shutter of the type comprising a fixed outer frame and one or more panel assemblies or panelings mounted within the outer frame for relative horizontal movement. Still more specifically, the invention relates to the improved construction of these panel assemblies which are each composed of several prefabricated parts.

In the shutter of the type now under consideration, each panel assembly has customarily been made by joining panels of sheet iron or the like together by means of rivets or like fastening elements, at the expense of substantial time and labor. The panel assemblies so constructed, moreover, are not sufficiently durable partly because the rivets or the like in use inevitably rust with the lapse of time. As an additional disadvantage, the prior art panel assemblies as a whole are relatively heavy and are therefore not easily movable to their open or closed positions.

SUMMARY OF THE INVENTION

In view of the listed disadvantages of the prior art, it is an object of this invention to provide a shutter having at least one panel assembly which is mounted within a fixed outer frame for relative horizontal movement and which is easily and economically manufacturable on a mass production basis.

Another object of the invention is to provide, in the shutter of the type defined, a panel assembly comprising several prefabricated interengageable parts which can be easily put together without the need for the use of rivets, screws, bolts, or like fastening elements.

Still another object of the invention is to provide, in the shutter of the type defined, a panel assembly which is durable, light in weight, and aesthetically appealing.

With these objects in view and the other objects hereinafter set forth, this invention provides a panel assembly, for use in the shutter of the above described type, which comprises a supporting frame and a series of elementary panels mounted within the supporting frame in a continuous plane. The supporting frame consists of top and bottom rails and a pair of stiles. One of the stiles has a tongue, and the other stile a pair of clamping jaws, which tongue and jaws are so shaped and sized as to be capable of clamping interengagement. Each elementary panel also has a tongue along one of the lateral edges thereof which is exactly identical with the tongue of the said one stile, and a pair of clamping jaws along the other lateral edge which is exactly identical with the jaws of the said other stile. The stiles and elementary panels can therefore be easily joined together by the clamping engagement of the tongues by the respective pairs of jaws, in such a manner that, according to a preferred embodiment of the invention hereinafter disclosed, only seams between the adjacent parts are visible from outside the shutter.

The features which are believed to be novel and characteristic of this invention are set forth with particularly in the appended claims. The invention itself, however, together with the further objects and advantages thereof, will become more apparent and understandable as the description proceeds, with reference taken to the accompanying drawings which illustrate, by way of example only, the preferred embodiment of the invention and in which like reference characters denote corresponding parts of the several views.

DESCRIPTION OF THE PREFERRED EMBODIMENTS

Figure 1:
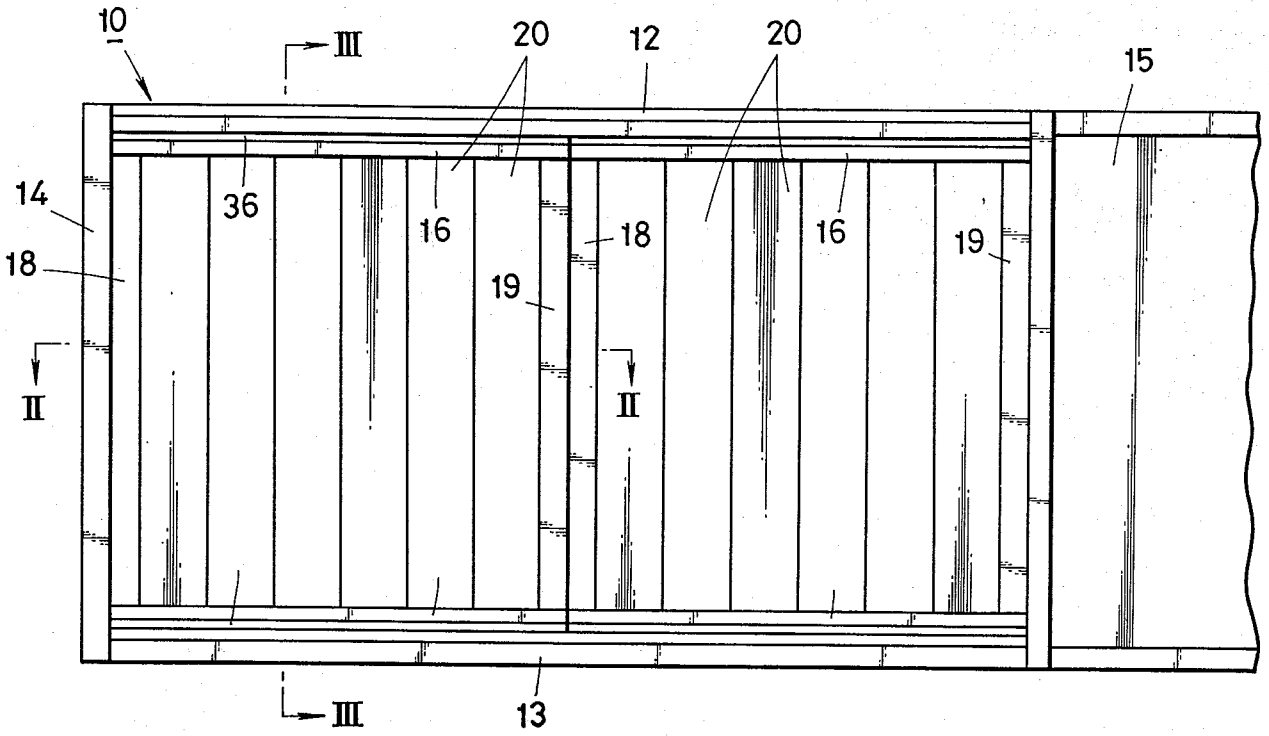
FIG. 1 is an exterior side elevational view of a shutter constructed in accordance with the concepts of this invention.

FIG. 1 best represents the general organization of the shutter according to the invention. As seen in this exterior side elevational view, the shutter is broadly composed of a stationary outer frame 10 and one or more, two in the illustrated embodiment, panel assemblies 11 mounted within the outer frame in one end and the same vertical plane for relative horizontal sliding movement.

The outer frame 10 comprises a header 12 and sill 13 at the top and bottom and a jamb 14 at one side secured at its ends to the header and sill in any convenient manner. Mounted at the other side of the outer frame 10 is a shutter box 15 adapted to successively receive the panel assemblies 11 therein when the shutter is opened and to permit manual readjustment, from inside the shutter, of the panel assemblies into side-by-side relationship.

Each of the panel assemblies 11 includes a supporting frame consisting of a top rail 16, a bottom rail 17, and a pair of stiles including a first stile 18 and a second stile 19. Closely fitted in the supporting frame are a series of elementary panels 20 of somewhat elongate, rectangular shape that are arranged in a continuous vertical plane with their opposed lateral edges in close interengagement, as later described in more detail. Both supporting frame and elementary panels of each panel assembly can be conveniently molded of aluminum.

Figure 2:
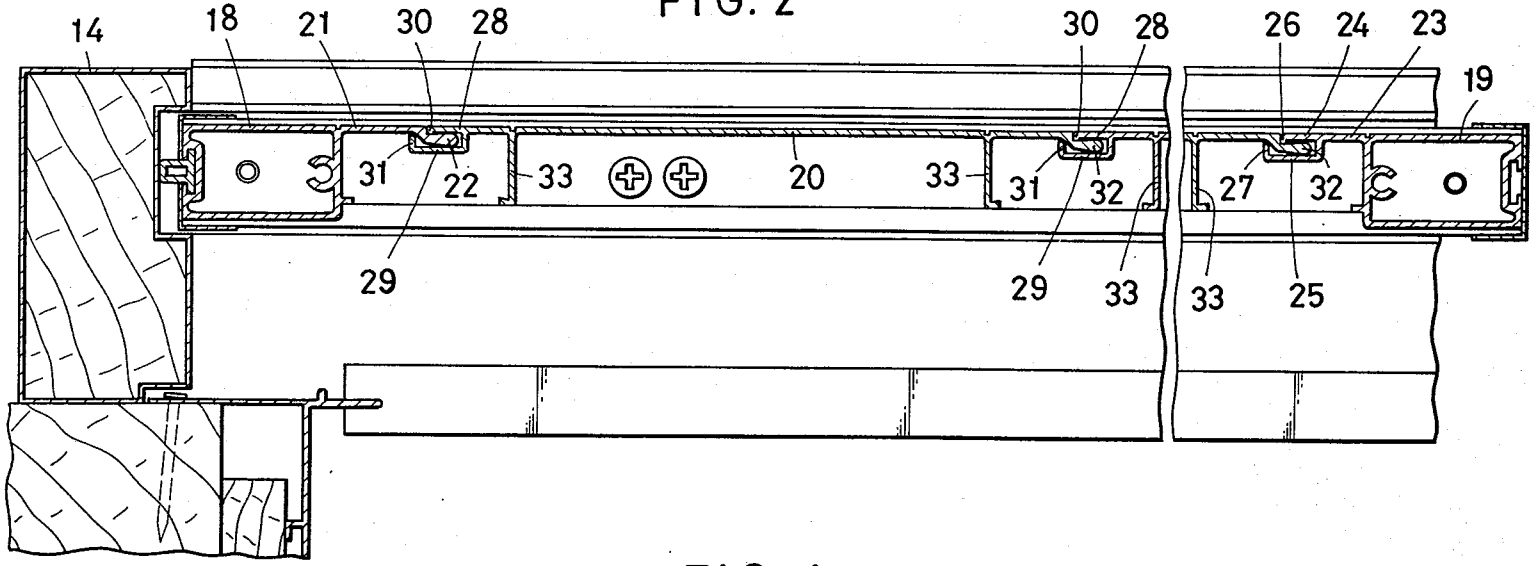
FIG. 2 is a partly broken away horizontal sectional view taken along the plane of line II — II in FIG. 1.
Figure 4:
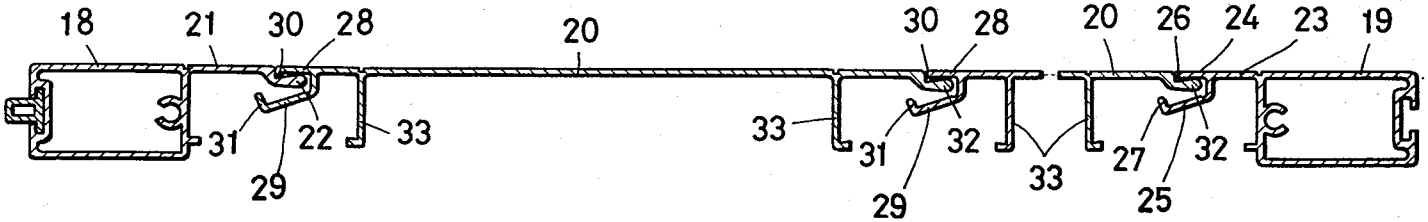
FIG. 4 is a horizontal sectional view explanatory of a mode of assemblage of a panel assembly for use in the shutter shown in FIG. 1.

The details of each panel assembly 11 are illustrated in FIG. 2 and also in FIG. 4, the latter view being the horizontal section of the panel assembly in the process of its assemblage or manufacture. As will be seen from these drawings, the stile 18 of the panel assembly includes a flange 21 projecting toward the other stile 19 and arranged in coplanar relationship to the elementary panels 20. The flange 21 terminates in a tongue 22 formed along its lateral edge opposed to one of the lateral edges of the adjacent elementary panel. It will be observed that the tongue 22 is in offset relationship to the flange 21 and is arranged slightly interiorly, that is, downwardly as viewed in FIGS. 2 and 4 and toward the right as viewed in FIG. 3, with respect to the plane of the flange 21 and the elementary panels 20. The tongue 22, moreover, gradually increases in thickness toward its tip remote from the stile 18.

The other stile 19 also includes a flange 23 projecting toward the stile 18 and arranged in coplanar relationship to the elementary panels 20. This flange 23 terminates in a pair of clamping jaws 24 and 25 formed along its lateral edge opposed to one of the lateral edges of the adjacent elementary panel 20. The exterior jaw 24 is formed as an extension of the flange 23 and is therefore arranged in the same plane therewith. The interior jaw 25 branches off, so to say, from the flange 23 and is only slightly longer in its horizontal or transverse dimension than the exterior jaw 24. Both exterior and interior jaws 24 and 25 have rims 26 and 27, respectively, which are formed along their tips remote from the stile 19 and which are directed substantially toward each other.

The several elementary panels 20 fixedly mounted within the supporting frame of each panel assembly 11 are exactly identical in construction, so that the description of one elementary panel applies to all.

With reference to FIGS. 2 and 4, therefore, one representative elementary panel seen in its entirety therein has a pair of clamping jaws 28 and 29 formed along one of its lateral edges opposed to the tongue 22 of the stile 18. These jaws, complete with rims 30 and 31, are exactly identical with the jaws 24 and 25 of the stile 19. Formed along the other lateral edge of the representative elementary panel is a tongue 32 which also is exactly identical with the tongue 22 of the stile 18.

As may now be apparent, the stile 18 is connected to the adjacent elementary panel 20 by the clamping engagement of the tongue 22 of the former by the jaws 28 and 29 of the latter. The elementary panels 20 are connected to each other by the clamping engagement of the tongue 32 of each by the jaws 28 and 29 of the adjacent elementary panel. The stile 19 is connected to the adjacent elementary panel 20 by the clamping engagement of the tongue 32 of the latter by the jaws 24 and 25 of the former.

One or more, two in the illustrated embodiment, vertical mounting fins 33 project inwardly from each elementary panel 20, and the tips of these mounting fins are each bent at a right angle, for purposes hereinafter made apparent.

Figure 3:
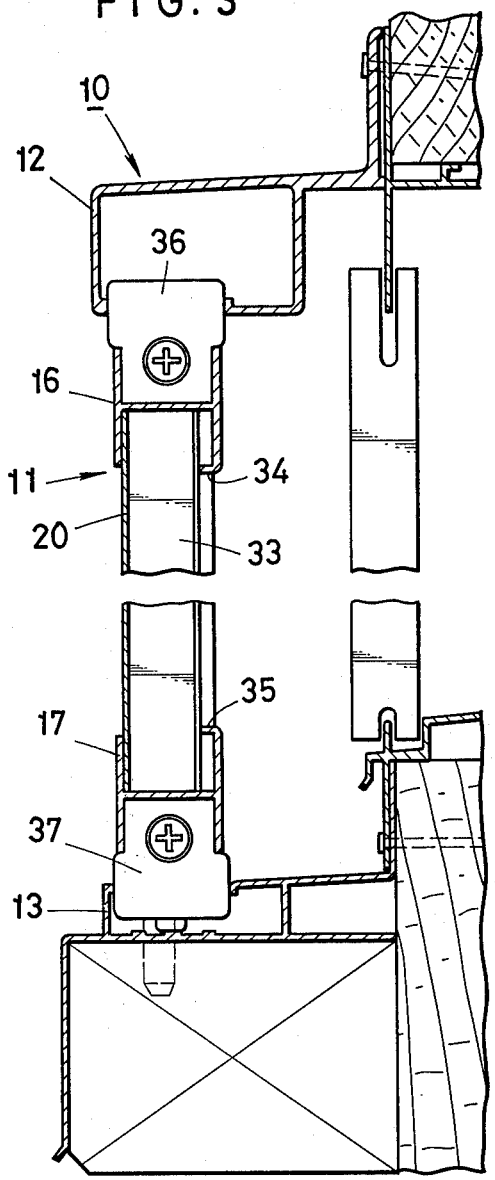
FIG. 3 is a partly broken away vertical sectional view taken along the plane of line III — III in FIG. 1.

As best illustrated in FIG. 3 the top and bottom rails 16 and 17, each of H-shaped cross section, are fitted over the top and bottom, respectively, of the stiles 18 and 19 and the elementary panels 20 that are connected to each other in the above described manner. The top and bottom rails 16 and 17 have rims at 34 and 35, respectively, that abut against the mounting fins 33 to restrain the elementary panels 20 from lateral displacement relative to the supporting frame of each panel assembly 11. The top and bottom rails 16 and 17 are further fixedly provided with slides 36 and 37, respectively, that are slidably received in respective tracks formed in the header 12 and sill 13 of the stationary outer frame 10.

In the assemblage of each panel assembly 11 constructed as hereinbefore described, it will be noted from FIG. 4 that the interior jaw 25 of the stile 19 and the interior jaw 29 of each elementary panel 20 are initially set apart from the exterior jaws 24 and 28 respectively. The tongue 22 of the stile 18 and the tongue 32 of each elementary panel 20 are inserted between the pairs of jaws 24 and 25, and 28 and 29, as in the drawing. By then pressing the interior jaws 25 and 29 toward the respective exterior jaws 24 and 28, the tongues 22 and 32 can be tightly clamped therebetween. The rims 26 and 27 on the jaws 24 and 25 of the stile 19, and the rims 30 and 31 on the jaws 28 and 29 of each elementary panel 20, are effective to assure the positive clamping of the respective tongues 22 and 32 by the jaws. With the stiles 18 and 19 and the elementary panels 20 thus connected together without use of any fastening element, the panel assembly is completed as the top and bottom rails 16 and 17 and the slides 36 and 37 are secured thereto as in the drawings.

Having thus described the shutter construction according to the invention, it is believed that the many objects for which it was designed have been fully accomplished. However, while the invention has been shown and described herein in terms of but one of its various possible adaptions, certain additional modifications may well occur to those skilled in the art within the broad teaching hereof. All such modifications, therefore, should and are intended to be comprehended within the scope of the invention as sought to be defined by the following claims.

What is claimed is:

1. In a horizontally movable shutter construction including a fixed outer frame and at least one panel assembly mounted within said outer frame, the improvement wherein said panel assembly comprises, in combination: a supporting frame including a top rail, a bottom rail, and first and second stiles; said first stile having a tongue projecting toward said second stile; said second stile having a pair of clamping jaws projecting toward said first stile, said jaws being so shaped as to be capable of clamping engagement of said tongue; and a series of elementary panels fixedly mounted in a continuous plane within said supporting frame; said elementary panels each having a tongue along one of the lateral edges thereof which is exactly identical with said tongue of said first stile, and a pair of clamping jaws along the other lateral edge thereof whih is exactly identical with said jaws of said second stile; whereby said elementary panels are connected to each other and to said first and second stiles solely by the clamping engagement of said tongues by said pairs of jaws, respectively, in such a manner that the outer surfaces of said elementary panels and said first and second stiles are arranged in coplanar relationship to each other; the tongue of said first stile and the jaws of said second stile being formed on flanges integral with said first and second stiles respectively, said flanges being disposed in coplanar relationship to said elementary panels; each of the tongues of said first stile and said elementary panels being disposed slightly interiorly with respect to the plane of said elementary panels, each of the pairs of jaws of said second stile and said elementary panels consisting of a first jaw disposed in the plane of said elementary panels and a second jaw disposed further interiorly of said tongues; each of the tongues of said first stile and said elementary panels gradually increasing in thickness toward the tip and extending in offset relationship to the flange of said stile and being arranged slightly interiorly, each of the pairs of jaws of said second stile and said elementary panels having rims formed along the tips of the respective jaws, said rims being disposed to assure positive engagement of said tongues by said jaws to maintain said coplanar relationship of said elementary panels and first and second stiles.

2. The improvement as recited in claim 1, wherein each of said elementary panels has at least one mounting fin adapted to restrain the elementary panel from lateral displacement relative to said supporting frame.

* * * * *